US006062986A

United States Patent [19]

Kaise

[11] Patent Number: 6,062,986

[45] Date of Patent: May 16, 2000

[54] PUTTER CLUB

[76] Inventor: Yukihiro Kaise, 6-1-13-102 Aoi, Adachi-ku, Tokyo, Japan

[21] Appl. No.: 09/081,121

[22] Filed: May 19, 1998

[51] Int. Cl.[7] ..... A63B 69/36

[52] U.S. Cl. ..... 473/242; 473/252; 473/253; 473/254

[58] Field of Search ..... 473/252, 242, 473/238, 244, 219, 231, 250, 251, 268, 254, 253

[56] References Cited

U.S. PATENT DOCUMENTS

| | | | |
|---|---|---|---|
| 3,955,819 | 5/1976 | Yokich . | |
| 4,128,244 | 12/1978 | Duclos | 473/242 |
| 4,135,720 | 1/1979 | Lancellotti | 473/244 |
| 4,209,172 | 6/1980 | Yamamoto | 473/242 |
| 4,231,576 | 11/1980 | Perkins | 473/242 |
| 4,962,931 | 10/1990 | Jazdzyk | 473/252 |
| 5,429,366 | 7/1995 | McCabe | 473/242 |
| 5,433,446 | 7/1995 | Lindstedt | 473/242 |
| 5,830,078 | 11/1998 | McMahan . | |
| 5,913,731 | 6/1999 | Westerman . | |

FOREIGN PATENT DOCUMENTS

| | | |
|---|---|---|
| 2-71769 | 3/1990 | Japan . |
| 3-18380 | 1/1991 | Japan . |
| 5-137820 | 6/1993 | Japan . |
| 018131547 | 5/1996 | Japan . |

*Primary Examiner*—Sebastiano Passaniti
*Attorney, Agent, or Firm*—McGlew and Tuttle, P.C.

[57] ABSTRACT

The habits of the golfer can be determined during the address from the coincidence status between a reference line 4 and a center line 8 or the plus or minus graduation (judgement) lines 9 or 10 by providing the reference line 4 on the upper face 2 of head 1, providing a view window 6 at the backward of this reference line 4, and by providing the center line 8 and the plus and minus graduation lines 9 and 10 downward the view window 6. Further, more than two parallel lines 11 can be provided on the upper face 2 of head 1. Moreover, the graphics 14 of the club (pole side) and graphics 15 of the ball (head side) are completed when the setting has been made correctly. The graphics 14 is provided on the upper face 2 of head and the pole 12. In addition, the judgement line 7 shall be previously provided to the heel or toe side.

3 Claims, 5 Drawing Sheets

PUTTER CLUB

FIELD OF THE INVENTION

The present invention relates to a putter club capable of setting the club head with respect to a golf ball as per the fundamentals of putting, or capable of addressing the ball or being set based on ones posture after first recognizing ones own setting habit for entering into a putting posture every time and capable of correctly the setting of the face plane to the hitting direction and moreover capable of correctly setting the sweet spot of the club against the center of ball.

BACKGROUND OF THE INVENTION

A putter golf club is publicly known wherein a line is drawn in a right angle against the face plane so that a ball may be correctly set to the sweet spot or that the ball may be correctly hit out to the target direction (for example, Japanese Unexamined Patent Publication No. 2-71769, Japanese Unexamined Patent Publication No. 3-18380).

Further, a putter head has been proposed (Japanese Unexamined Patent Publication No. 5-137820) which is characterized in installing a check plate with a cross line consisting of a line grave along the backward extension line of the club sweet spot putter head. A similar check cross line similar to the cross line is engraved remotely upwardly of the engraved face so that the address can be made while keeping not only the hitting direction of ball but also the loft of face plane and the inclination of the sole always at constant states. This proposed putter head is also characterized in enabling one to collimate the cross line and the check cross line at the same time.

However, in case of this putter head, the address can be checked but only by matching the crosses when the putting is made under quite the same conditions such that the height is identical, the arm length is identical, grip position is identical and the inclination of making the address on the green is identical. Unfortunately, the conditions usually all differ. Further, each person typically has their own addresses and setting habits respectively. There are individuals that hit the ball from the backward side, individuals that hit the ball while looking at it from a front side, and furthermore, the direction of looking at the ball differs depending on the dominance of one eye or the other (the strong point eye).

Because every person has his or her own putting address posture and set, ones own correct address and putting habit can not be used if one tries matching it with the use of the cross. Also, it is impossible to conduct the address and set in line with ones own habit at all times with the use of such cross.

Next, in case of matching the hitting direction with the line in a right angle with the face provided on the upper face of club face with a conventional putter, when setting the club face after the ball, this line is too short in matching to it. In the case of the cross line, the line in a right angle direction becomes shorter similarly if this cross should get deviated and it becomes difficult to match the hitting direction.

The sweet spot is matched usually to the center of ball and moreover the face direction is matched to the hitting direction when setting the club face back to the ball. However, the center of ball doesn't correctly coincide with the sweet spot in many cases because the ball is not always seen from right above due to the above mentioned habits during the address.

SUMMARY AND OBJECTS OF THE INVENTION

An object of this invention is to provide a putter club not only capable of conducting the set as per the golf fundamentals but also capable of giving the user knowledge that the judgement line depicted takes into account the habits during the address or setting to the club head for correcting the habits or for making every address in line with the habits, capable of correctly setting the hitting direction of head and also capable of matching the sweet spot to the place after the center of ball.

According to the invention, a reference line at a right angle with the face plane is provided to indicate the position of sweet spot. The line is at the upper face of the club head in the putter club. A plate with a view window is also provided rearwardly of this reference line. A plurality of judgement lines are provided in parallel with the reference line and are provided downwardly of the view window.

Further, according to the invention a plurality of reference lines in parallel with the face plane of this club head are installed on the upper face of club head in the putter club.

Moreover, the head-side set graphics are provided symmetrically with the sweet spot as its center, which is the upper face of club head in the putter club. The ball-side set graphics are completed as a full graphic when the ball-side set graphics coincide with the head-side set graphics installed on the surface of golf ball.

Furthermore, the invention includes a reference line at a right angle with the face plane installed at the position of the sweet spot, which is the upper face of club head, in the putter club. A center line coinciding with the reference line when viewed from right above and also a plurality of judgement lines fore and aft with this center line being caught are installed on the upper face by one stage lower at the backward of the upper face.

In addition, the invention provides a center line installed to the side of the club heel as compared to the reference line when viewed from right above.

Further, the includes a center line installed to toe-side as compared to the reference line.

Each line in the structure of the invention may be described as part of a marking system, or a plate may be provided (affixed) where the lines are marked, or the lines may be directly printed. This feature is optional. Further, the plate forming a view window may be integrally formed with the head, may be mounted subsequent to the head formation, or may be an optionally attachable/detachable one.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
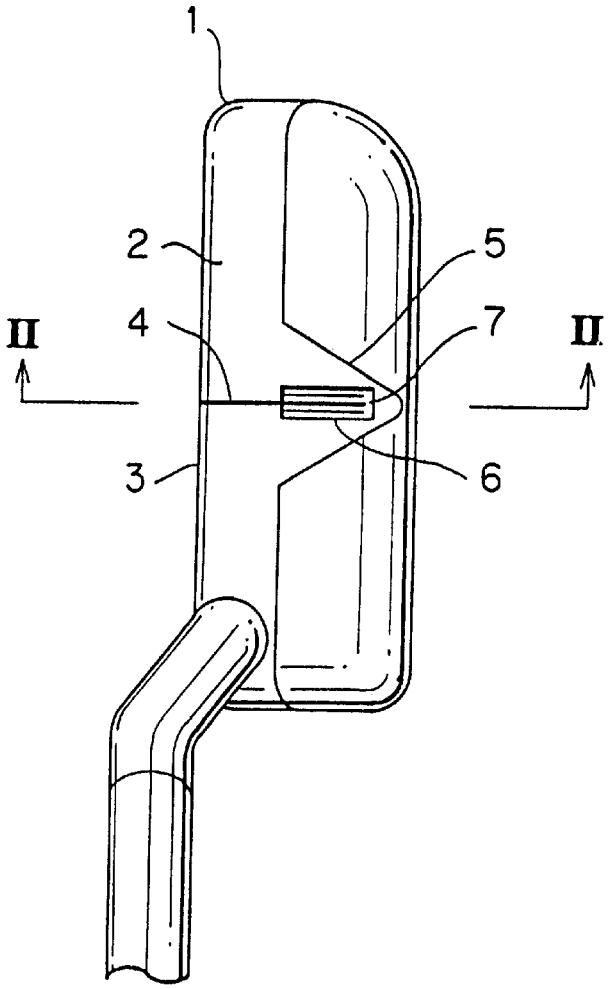
FIG. 1 is an explanatory view showing the putter head relating to a first embodiment (Embodiment 1) according to the invention.

Referring to the drawings in particular, the invention comprises a putter club which is shown in FIG. 1 in which a user may address the ball and set with the users own way on a flat place. When doing this, the reference line coincides with the center line in the case as per the fundamentals. With the toe up habit (the habit of reclining the shaft) during the set the line can be seen from the view window against the reference line. This line coincides with the reference line is the line deviated to the heel side by the action of land-offset. In case of the person having the heel-up habit on the other hand, the reference line coincides with the line deviated to the toe side. It can be known with what habit one is making the address and setting the club head with this coincidence relation of this line. The user can remember this, and try making the address and set in line with this habit at the next putting. By doing so, the putting can be made with the same image every time, and it is sure that the probability for hole-in-one putt can be increased.

Furthermore, the invention relates to the angle of shaft during the address, but if the position of the eyes are sided to the front site in case the shaft angle is as per the reference, the reference line coincides with the judgement line sided to the toe, and the reference line coincides with the judgement line sided to the heel if the eyes' positions are sided to the tip.

Moreover, since the reference line and the judgement line come to a straight line with no regard to the inclination of club head in accordance with the present invention, the club face can be matched easily to the hitting direction.

Further, in accordance with another aspect of the invention, since more than two lines parallel to the face plane are drawn, they are very much easier to be seen in comparison with a single line, and therefore the face plane can be matched much easier to the hitting direction.

Next, in accordance with another feature of the invention, the sweet spot of the club can be placed after the center of pole and the club face can be set by correctly matching the graphics when the head side graphics and the pole side graphics are completed with the nice coincidence to each other and the club side sweet spot has coincided to the center of pole.

Next, in accordance with another feature of the invention, a plate and an inclination are added to the club shaft described above. This club shaft is suited to a person having a feeling of disorder, and the effect of operation is identical to the putter described above.

Another aspect of the invention accounts for the fact that the positions of the eyes are not usually right above the sweet spot but are a bit forward. Because many golf players make the address while slightly inclining the shaft or erecting the shaft, the matching can be made easier by the golf players practicing such habits if the center line is provided a bit to the toe side or to the heel side against the reference line.

Figure 2:
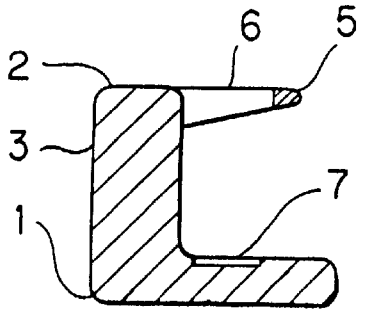
FIG. 2 is a cross sectional view taken along the line II—II' of FIG. 1.

FIG. 1 through FIG. 4 show a first embodiment of the invention (Embodiment 1), wherein FIG. 1 and FIG. 2 show the structure of the head of the putter. Numeral 1 is a putter head, Numeral 2 is the upper face of head 1, Numeral 3 is a face and Numeral 4 is a reference line engraved on the sweet spot portion in this upper face 2 and is at a right angle with the face 3. Numeral 5 is a plate extending the upper face 2 in horizontal direction in the backward (rearward) direction of this reference line 4, and a rectangular view window 6 is provided at the center of this plate 5.

Numeral 7 is a judgement line provided just below the view window 6, Numeral 8 is a center line drawing on the extension line of the reference line 4, Numeral 9 is a plus graduation line drawn in parallel with the toe side of head 1 with the center line 8 as its boundary, and Numeral 10 is a minus graduation line drawn in parallel with the heel side of head 1 with the center line 8 as its boundary.

Figure 3:
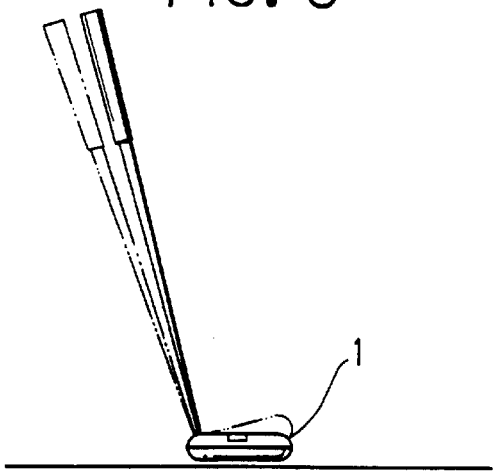
FIG. 3 is an explanatory view showing the relation between the head during address and the inclination of shaft.
Figure 4A:
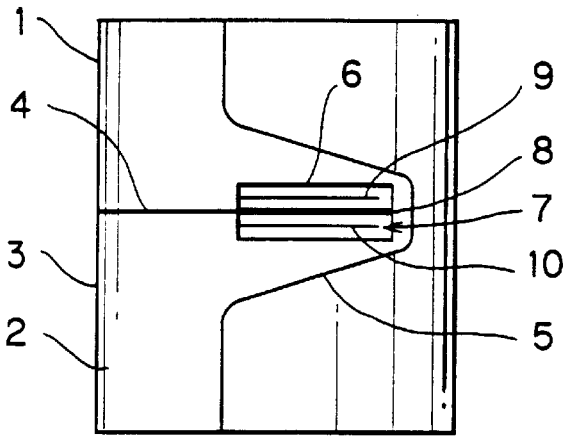
FIG. 4*a* and 4*b* are explanatory views of reference graduation during the address based on the address and player's habit interacting with the putter reference.
Figure 4B:
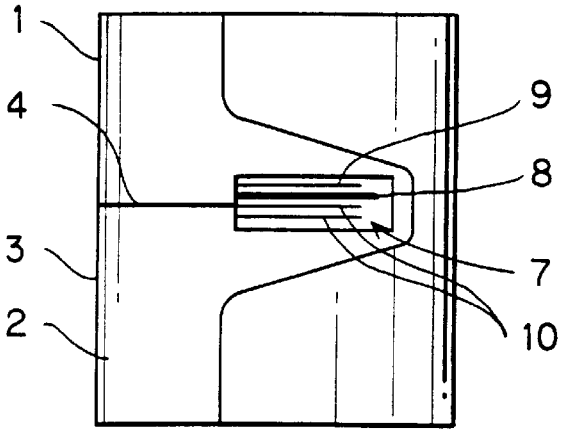

In the putter club head 1 in accordance with the first embodiment, the reference line 4 coincides with the center line 8 as shown in FIG. 4 (*a*) if the judgement line 7 should be seen from right above the view window 6 of head 1 when the putter club should be soled as per the fundamental as shown in FIG. 3. If the address should be made under this status, the address and setting as per the design of club can be obtained.

On the other hand, if the address should be made with the shaft being a bit inclined as shown by the dotted chain line in FIG. 3, the line inside the view window 6 coinciding with the reference line 4 becomes the side of minus graduation line 10 (the heel side) as shown in FIG. 4 (*b*). If the address should be made with the shaft a bit being erected to the contrary, the line inside the view window 6 coinciding with the reference line 4 becomes the side of plus graduation line (the toe side). It is possible to judge the status of ones own address by looking at this, and to achieve the basic address or to correct it.

Further, the above description refers to the relation between the reference line 4 and the judgement line 7 with the shaft of putter being inclined, but there is such a case that the player places his or her eyes before or outside the pole and not right above the pole (view window 6) as the habit during the address with the head 1 being soled as per the fundamentals. In this case, because ones own habit can be understood by looking at the coincidence status between the reference line 4 and the judgement line 7 in the similar manner, one should always keep the address matched to this habit if the better result can be obtained by maintaining this habit.

Figure 5:
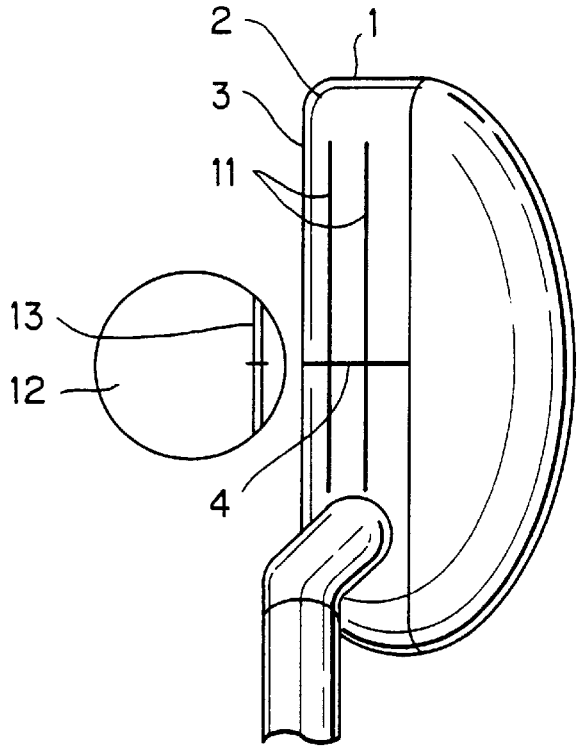
FIG. 5 is an explanatory view of an embodiment in which two parallel lines are installed on the upper face of head.

A second embodiment (Embodiment 2) allows for the orientation of face 3 to be known well by providing two lines 11 in parallel with the face 3 on the upper face 2 of head 1 as shown in FIG. 5. Further, using this putter head 1 shown in FIG. 5, it becomes possible to correctly set the head at the backward (rearward) side of ball 12 by using the ball 12 depicting the line 13 (ball graphics) which becomes a straight line when viewed from above on the surface of ball 12 and matching this line 13 with the parallel lines.

Figure 6:
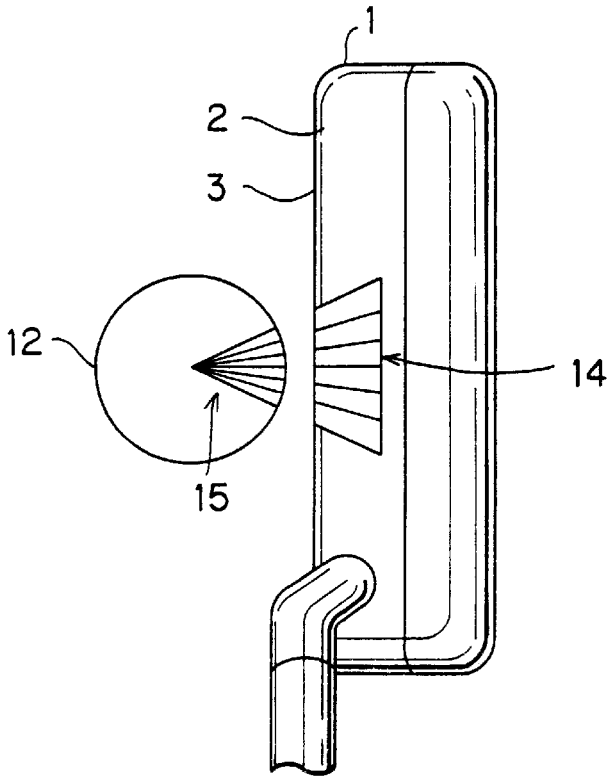
FIG. 6 is an explanatory view of a third embodiment (Embodiment 3) of the invention depicting the graphics which coincide and are completed when the setting has been made to the head of the club and the ball mutually to each other.

A third embodiment of the invention (Embodiment 3) provides the graphics 14 and 15 that coincide. The combination graphic is completed by both the putter head 1 (putter head graphics) and ball 12 (golf ball graphics), when they are correctly set, as shown in FIG. 6. If this arrangement is made, not only the head can be correctly set to the place after the ball 12 but the center of ball 12 can be coincided with spot. In addition, the hitting direction of ball 12 can be decided by this matter. The graphics may be varied and may include other line graphics but also other graphics include manufacturers trademarks or other advertisements or fanciful graphics.

Figure 7:
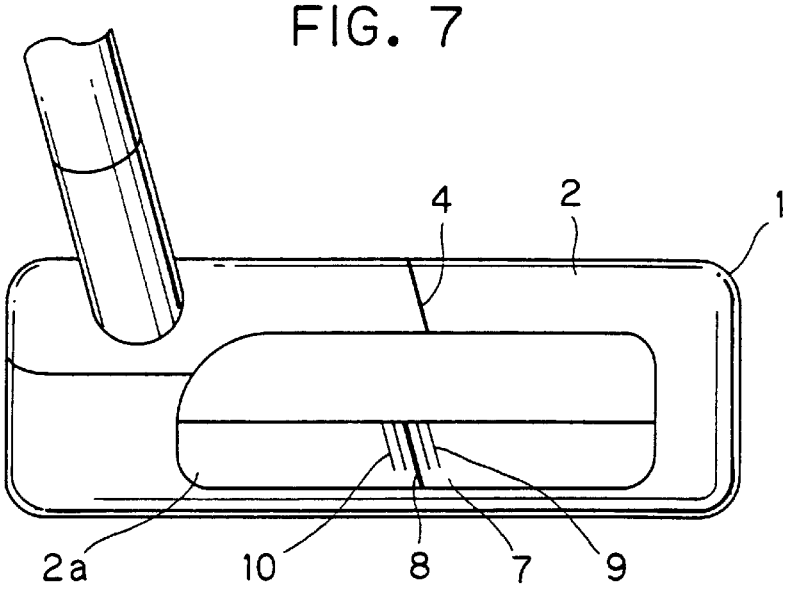
FIG. 7 is an explanatory view of an example of depicting the reference line 4 on the upper face of head of the putter and installing the judgement line on the upper face of lower stage.
Figure 8:
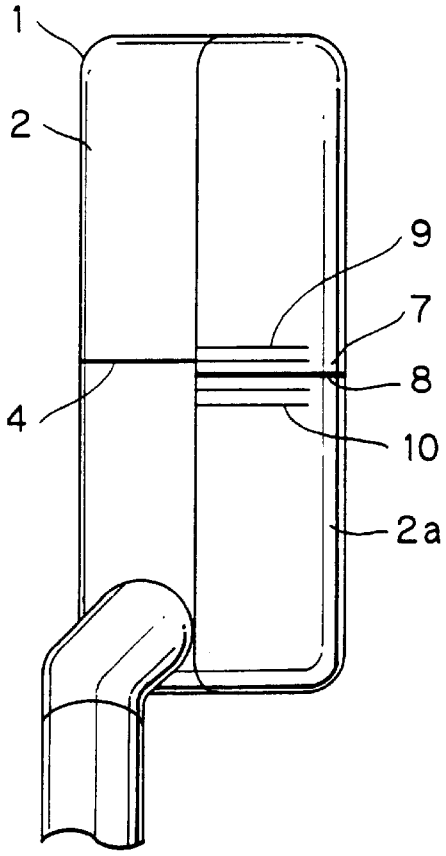
FIG. 8 is an explanatory view of another embodiment which has the judgement line installed to the side of heel.

The fourth embodiment of the invention (Embodiment 4) provides the reference line 4 on the upper face 2 of putter head 1 as shown in FIG. 7 and FIG. 8. A judgement line 7 is depicted on the upper face 2*a* which is lower by one stage at the backward (rearward) side, and provides the effect of operation similar to that of Embodiment 1.

The fifth embodiment (Embodiment 5) of the invention provides from the first a judgement line 7 to the heel side against the reference line 4 as shown in FIG. 8.

Figure 9:
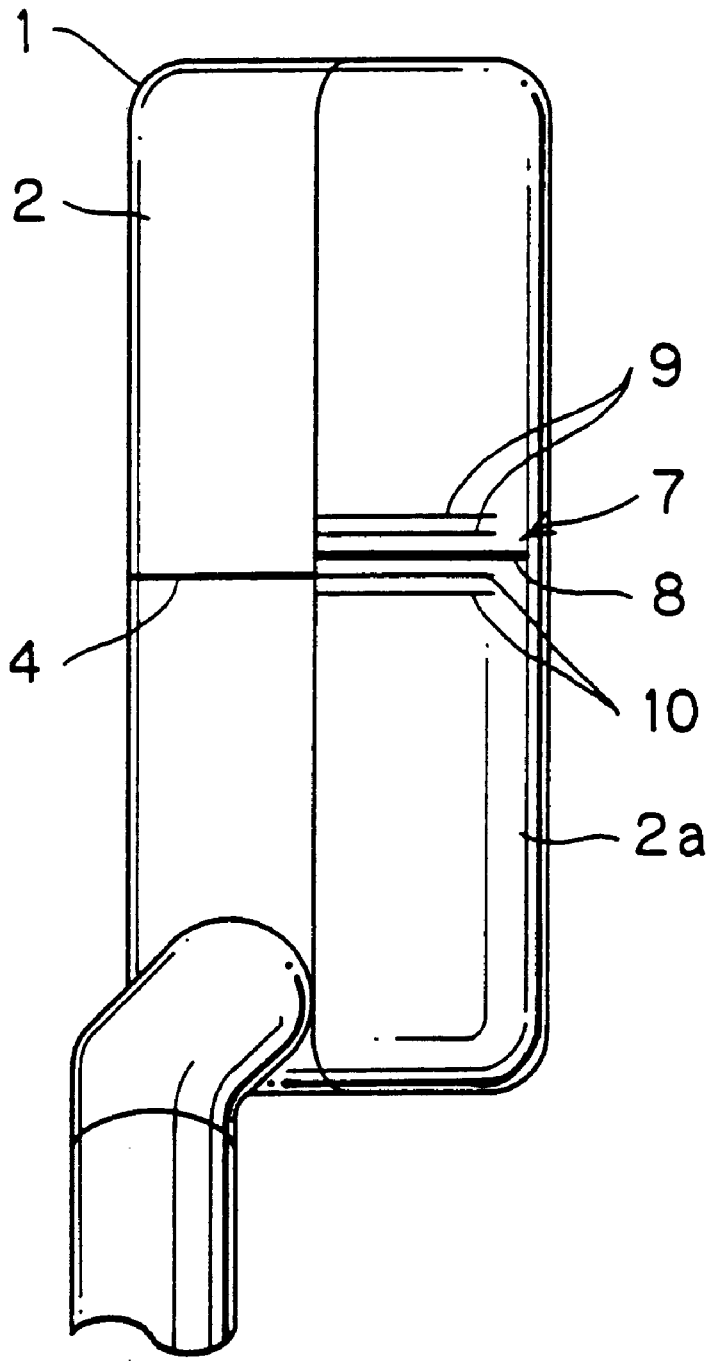
FIG. 9 is an explanatory view of embodiment which has the judgement line installed to the side of toe.

The sixth embodiment (Embodiment 6) provides from the first a judgement line 7 to the toe side against the reference line 4 as shown in FIG. 9.

In accordance with the invention, such effects are attained that the set as per the fundamentals or the correction of ones habits or the correction of the address matched to the habit can be made by providing the graduation for judgement on the head of putter, where the compliance with fundamentals during address or the habit can be known.

Further, according to another aspect of the invention, the orientation of the face of the putter head can be known well and the head can not only be set correctly to the backward pole, but the ball can also be correctly hit against the target direction.

In addition, in the invention as described in claim 3, not only the center of ball can be made to coincide with the sweet spot of head but the ball can also be hit correctly to the target direction.

While specific embodiments of the invention have been shown and described in detail to illustrate the application of the principles of the invention, it will be understood that the invention may be embodied otherwise without departing from such principles.

What is claimed is:

1. A putter club, comprising:

a putter club head with a hitting face having a hitting face plane and an upper surface;

a reference line on said upper surface of said club head at a right angle with the face plane provided to designate the position of sweet spot;

a putter head extension extending away from a club head main portion on a side of said putter head opposite said hitting face, said putter head extension having an upper surface which is downwardly with respect to said putter club head upper surface;

a plurality of judgement lines provided on said putter head extension upper surface parallel with respect to said reference line, provided downwardly with respect to said reference line;

a plate with a view window disposed rearwardly of said reference line extending above said putter head extension upper surface, said plurality of judgement lines being provided downwardly of said view window, one or more of said plurality of judgement lines being viewable through said view window.

2. A putter club according to claim 1, further comprising: a center line coinciding with said reference line when viewed from directly above, said center line being provided on said putter head base extension upper surface, said plurality of judgement lines being disposed fore and aft of said center line.

3. A putter club, comprising:

a putter club head with club head main portion having a hitting face, a club head main portion upper surface, a putter head extension extending away from said club head main portion on a side of said putter head opposite said hitting face, said putter head extension having an upper surface which is vertically downwardly disposed with respect to said putter club head upper surface;

a reference line on said upper surface of said club head at a right angle with respect to said hitting face;

a plurality of lines disposed on said putter head extension upper surface, said plurality of lines including a center line coinciding with said reference line when viewed from directly above and judgement lines being disposed fore and aft of said center line, said plurality of lines being provided on said putter head extension upper surface parallel with respect to said reference line;

a plate with a view window disposed rearwardly of said reference line extending above said putter head extension upper surface, said plurality of judgement lines being provided downwardly of said view window, one or more of said plurality of judgement lines being viewable through said view window.

* * * * *